United States Patent [19]

Almeras

[11] Patent Number: 4,848,209

[45] Date of Patent: Jul. 18, 1989

[54] SEALING OR DRIVING APPARATUS FOR WORK UNDERWATER

[75] Inventor: Roland Almeras, Tournon, France

[73] Assignee: Societe de Prospection et d'Inventions Techniques (S.P.I.T.), France

[21] Appl. No.: 243,884

[22] Filed: Sep. 13, 1988

[30] Foreign Application Priority Data

Sep. 15, 1987 [FR] France ..... 87 12754

[51] Int. Cl.[4] ..... B25C 1/08

[52] U.S. Cl. ..... 89/1.14; 42/1.14; 227/9

[58] Field of Search ..... 42/1.14; 89/1.14, 5, 89/27.12; 102/531, 530; 227/9, 10

[56] References Cited

U.S. PATENT DOCUMENTS

| | | | |
|---|---|---|---|
| 3,370,770 | 2/1968 | Henning et al. | 227/9 |
| 3,765,331 | 10/1973 | Montesi | 89/1.14 |
| 3,765,332 | 10/1973 | Baker | 89/1.14 |
| 4,061,261 | 12/1977 | Fredriksson et al. | 89/1.14 |
| 4,100,855 | 7/1978 | O'Callaghan | 42/1.14 |
| 4,542,694 | 9/1985 | Wells | 102/223 |
| 4,565,312 | 1/1986 | Berry | 227/10 |

FOREIGN PATENT DOCUMENTS

| | | |
|---|---|---|
| 496960 | 12/1919 | France . |
| 898103 | 4/1945 | France . |
| 205610 | 10/1923 | United Kingdom . |

*Primary Examiner*—David H. Brown

*Attorney, Agent, or Firm*—Thomas W. Buckman; Neal C. Johnson

[57] ABSTRACT

The apparatus, provided for undersea work, includes a barrel holder, a barrel for guiding a fastener intended to be driven by the gases of a propulsive charge and a percussion system for setting off the charge. The percussion system includes a striker, a bolt for cocking the striker, a tumbler for releasing the bolt, a trigger for actuating the tumbler and a chamber having a liquid intake orifice and a suction orifice. The tumbler is movable in the chamber and the trigger, when operated, closes the intake orifice, pushes back the liquid and moves the tumbler thus allowing percussion of the charge. Upon return of the trigger into the rest and rearming position, the suction orifice makes possible to compensate the leaks in the chamber and to use the apparatus again.

22 Claims, 5 Drawing Sheets

SEALING OR DRIVING APPARATUS FOR WORK UNDERWATER

The present invention relates to a sealing or driving apparatus including a barrel holder, a barrel for guiding a fixing element intended to be driven by the action of the combustion gaes of a propulsive charge and a percussion system for setting off the charge including a striker mounted in a breech, a bolt for arming the striker, a tumbler for releasing the bolt and a trigger for actuating the tumbler.

With undersea work becoming more and more frequent, numerous apparatus used up to now for open air work have been adapted for use in an underwater situation. Sealing apparatus using the energy supplied by a powder charge are particularly advantageous for this kind of work, because of their independent working and their compactness.

The working conditions and the nature of the work undertaken means that these tools deliver considerable power for example for fixing stud bolts and plugs. This power, appropriate under water, is much too high out of the underwater situation.

Document FR-A-496 960 teaches a safety device to be used in combination with a firing mechanism, arranged to operate only when immersed and which comprises a percussion system including a chamber having at least one liquid intake orifice, a percussion piston movable in the chamber and means operable for closing the intake orifice, for pushing back the liquid and moving the percussion piston and thus allowing percussion of a charge.

However, this device is essentially intended for firing mines, bombs and other immersed explosive bodies, so that it can be used only once.

The object of the present invention is then to provide a sealing apparatus only operating when immersed and not operating in the open air and which can be easy rearmed.

For this, the present invention relates to an apparatus of the above mentioned type, characterized by the fact that the percussion system includes a chamber having at least one liquid intake orifice, a percussion piston movable in the chamber and means operable for closing the intake orifice, for pushing back the liquid and moving the percussion piston and thus allowing percussion of the charge and a suction orifice for sucking liquid into the chamber upon biasing the operable means into rest and rearming, or cocking, position.

The firing system of the apparatus of the invention is then a hydraulic system which cannot operate in the open air, because of the compressible character of the air which cannot move the percussion piston, at least not sufficiently, for providing percussion. On the other hand, when the apparatus is immersed, the chamber of the percussion system fills up with liquid—it will the most often be water—which is practically incompressible and operation of said means may then, via the water volume, provide percussion. Furthermore, after firing, the apparatus of the invention can be rearmed and used, by sucking water into the percussion chamber to compensate the leaks due to the unavoidable clearances between the elements mounted in the chamber.

It is advantageous for the percussion piston to play the role of tumbler and the trigger the role of the operable means.

In this case, the trigger may advantageously have a percussion finger adapted for cooperating with another piston movable in the chamber. This other piston may be subjected to the action of a biasing spring. This other piston may also be fast with the percussion finger with respect to their displacement, the suction orifice be the intake orifice and be closable.

Again advantageously, the intake or suction orifice may be formed in the percussion piston.

But the percussion chamber may also be disposed so that the percussion piston may be inserted between the breech and the striker, which comes into abutment thereagainst when the operable means are not operated.

In this latter case, the operable means may be formed by the barrel, playing its percussion role during its recoil movement at the time of application of the apparatus, or else by the trigger. In this latter case still, the tumbler may be securely fixed to the trigger.

Advantageously, the operable means may be adapted for cooperating with a percussion finger fast with another piston movable in the chamber against the action of a return spring.

Finally, the fixing element is advantageously placed in a tubular element at one end of which the propulsive charge is disposed, the other end of the tubular element being closed by a device which can be perforated by the fixing element.

The invention will be better understood from the following description of several embodiments of the apparatus of the invention, with reference to the accompanying drawings in which.

Figure 1:
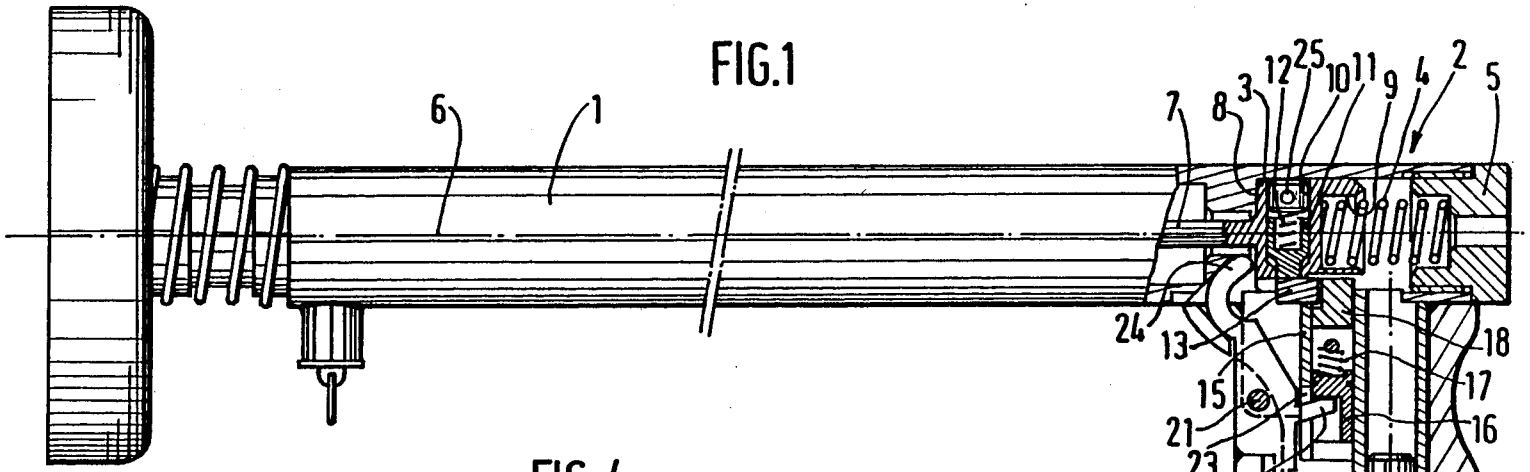
FIG. 1 is a partial view in axial section of a first embodiment of the invention, immersed and after firing.

Referring to FIG. 1, the apparatus of the invention includes a barrel holder 1 with axis 6, in which a barrel is mounted containing a tubular element at one end of which, the rear end, a propulsive powder charge is crimped, the other end, the front end, being closed by a closure means made from a material perforable by a fixing element—plug or stud—disposed inside the tubular element, at the rear of the barrel holder 1 is disposed a system 2 for firing or percussion of the charge. This system includes a striker 3, with a front rod 7, returned forwardly by a percussion spring 4 bearing both against the bottom of an axial recess 9 formed in the striker and against the bottom of a removable base 5, so as to abut against an annular shoulder 8 of a rear portion of the barrel holder, and forming a breech. Between rod 7 and the axial recess 9 for the percussion spring there is provided another transverse recess 10, in which is mounted a cocking pin or bolt 11, urged downwardly by spring 12 bearing, on one side, against the inner bottom of the pin, recessed for this purpose and, on the other side, a stop 25. With the immersed apparatus shown after firing, the cocking bolt 11 is pushed back inwardly of its housing 10, against the action of spring 12, bearing against a fixed key 13 and is flush with the lower surface of striker 3 and the upper surface of key 13.

Substantially under recess9 of the striker, in the position shown in FIG. 1, there is provided, in a grip or handle 14 of the apparatus, a transverse percussion chamber 15 having a water intake orifice 23. In chamber 15 are disposed two pistons, a first one 16 in the form of an upturned L urged in a direction opposite that of a second one here by a spring 17 bearing on a pin 26 and a second one 18 free to translate and playing the role of tumbler. In the embodiment shown in FIG. 1, and in the position shown there, tumbler 18 bears against key 13 through a shoulder provided for this purpose. The first piston 16 is engaged by an intermediate finger 19 of a trigger 20 and is urged in the direction of tumbler 18 against the action of spring 17. Trigger 20 is mounted for pivoting about a transverse pivot 21 against the action of a small holding spring 22 in tension providing slight urging towards grip 14. In the position shown in FIG. 1, trigger 20 has been operated and pressed against grip 14. The percussion finger 19 has pivoted anticlockwise, has caused piston 16 to rise for closing the intake orifice 23, which has ushed upwards, that is to say towards the striker, the volume of water imprisioned between piston 16 and tumbler 18, which has actuated or moved, towards the striker, the tumbler 18 which in its turn has pushed the cocking bolt 11 back into its housing 10 so as to release the striker, as will be explainedagain hereafter with reference to FIG. 2.

Figure 2:
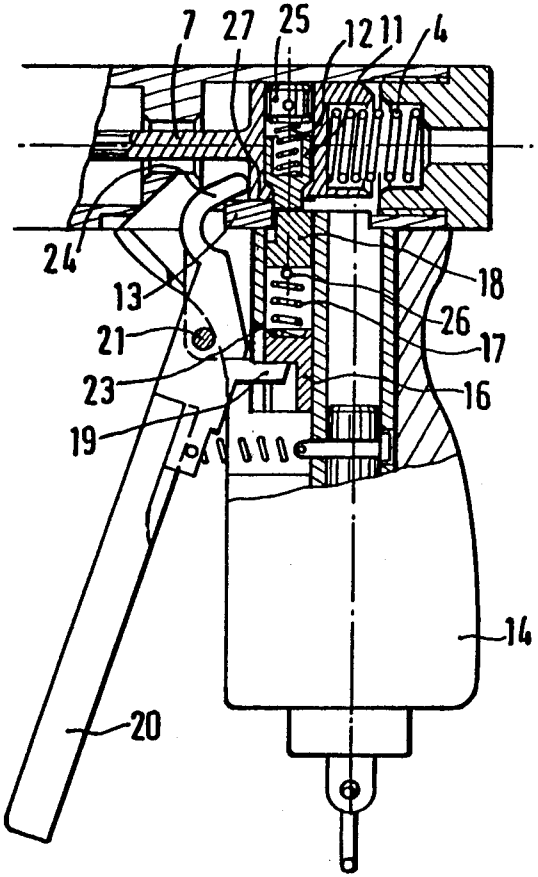
FIG. 2 is a view similar to that of FIG. 1, the percussion system of the apparatus being in the cocked position, before firing.

In FIG. 2, the apparatus is shown with its percussion system in the cocked position, before firing. The trigger has been moved manually outwardly away from grip 14. An end finger 24 of the trigger has pushed the striker 3 rearwardly against the action of its percussion spring 4 then compressed, so as to place the striker in the cocked position. The downwardly pivoted intermediate finger 19 has allowed the piston 16, under the action of its spring 17, to move away from the tumbler 18 so as to uncover the intake orifice 23. The cocking bolt 11 has passed behind key 13 and, under the action of its spring 12, has been able to leave its housing 10 so as to push the tumbler 18 back inwardly of chamber 15 and to come into abutment against key 13 and thus be cocked.

From this stage shown in FIG. 2, the operation of the firing system is easy to understand. With the apparatus immersed, the liquid penetrates through orifice 23 into chamber 15. After applying the apparatus against a material intended to receive the fixing element, and after operating the trigger 20 so as to bring it close to the grip 14, finger 19 causes the piston 16 to rise which closes the intake orifice 23. The volume of water enclosed in chamber 15 is driven upwardly and drives back the tumbler 18. This in its turn pushes back the cocking bolt 11 and when this latter is flush with the upper surface 27 of key 13, under the action of the spring striker 4 may be propelled forwardly so as to fire the charge whose combustion gases will propel the fixing element.

Figure 3:
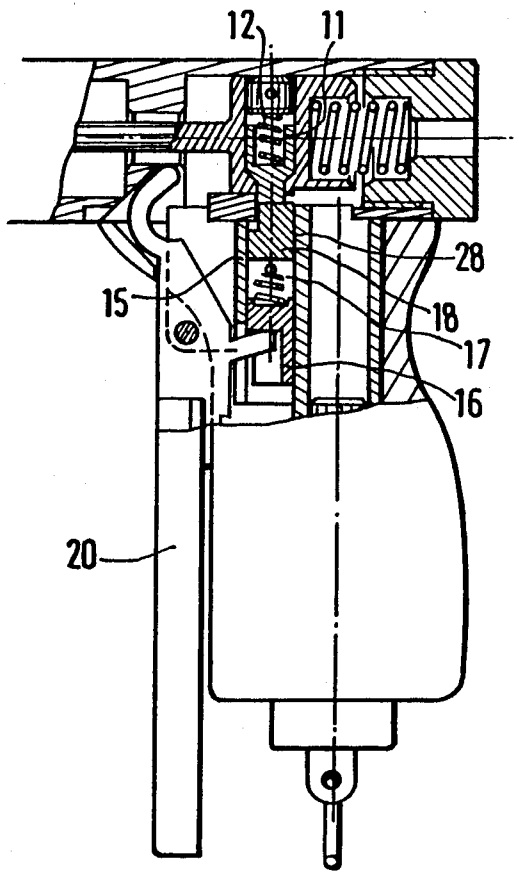
FIG. 3 is a view similar to that of FIG. 1, the apparatus being out of the water in the firing position.

In FIG. 3, the apparatus shown in the same position as in FIG. 1, in the firing position, but not after firing, which has not occurred, the apparatus being out of the water. With trigger 20 operated, the piston 16 has compressed a part of the volume of air previously enclosed in chamber 15, the rest of this air volume being discharged through the clearances 28 required for fitting the piston 16, 18 in chamber 15 and eventually also, as will be seen further on, through one or several calibrated orifices provided in particular for this purpose. The energy required for raising bolt 11, against the action of spring 12, being greater than that which tumbler 18 has been able to deliver to it, firing has not been able to take place.

Figure 5:
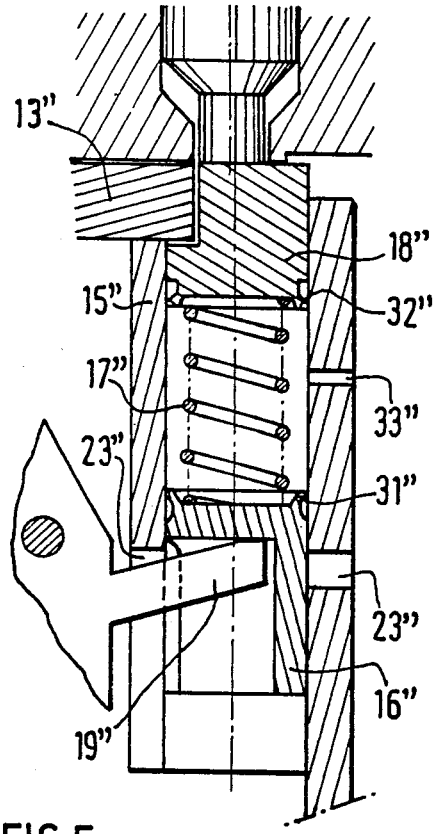
FIG. 5 is a view in axial section, at a larger scale, of a first variant of a percussion chamber of the apparatus of FIGS. 1–3.
Figure 6:
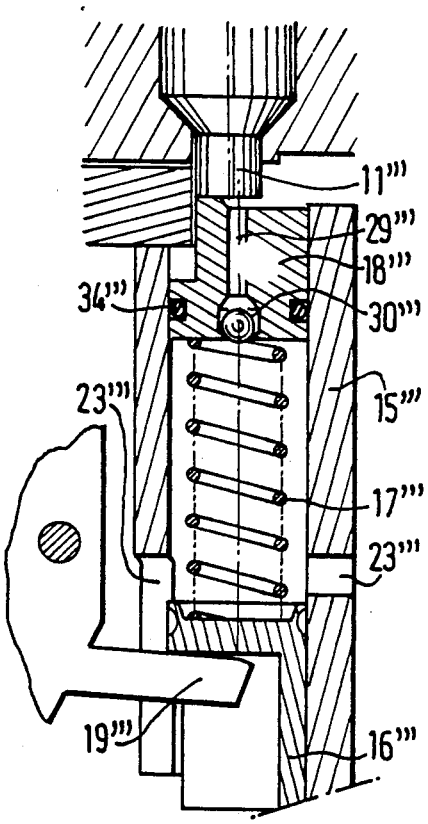
FIG. 6 is an axial sectional view, at a larger scale, of a second variant of construction of the percussion chamber of the apparatus of FIGS. 1–3.
Figure 7:
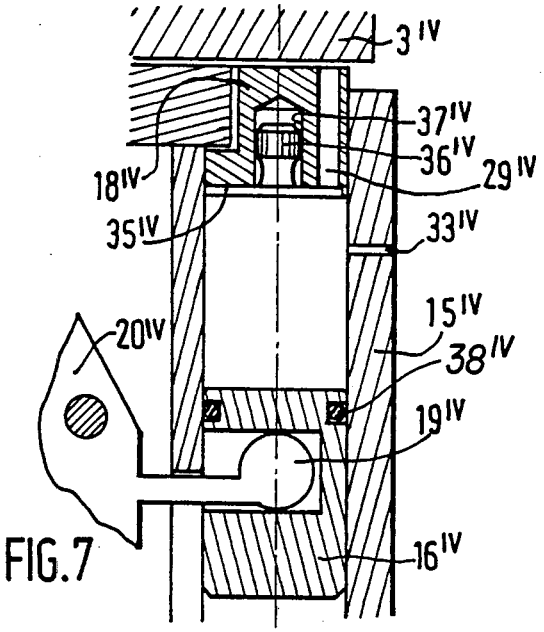
FIG. 7 is an axial sectional view, at a larger scale, of a third variant of construction of the percussion chamber of the apparatus of FIGS. 1–3.

FIGS. 5–7 show in more details three embodiments of the chamber of the percussion chamber of the apparatus of FIGS. 1–3, that of FIG. 5, just before firing, that of FIG. 6 in the cocked position and that of FIG. 7 after firing. The same functional elements as in the preceding Figs. are shown with the same references to which the indices ", ‴, 'v have been added respectively.

Pistons 16″ and 18″ of the chamber 15″ of FIG. 5 are each provided with a sealing lip 31″, 32″ providing a good, but not perfect, lateral sealing against the wall of chamber 15″. The spring 17″ bears by its two ends against the piston 16″, 18″. An escape orifice 33″ has been formed in the wall of chamber 15″ which comprises several water intake orifices 23″. After having abuted the apparatus and actuated trigger 20, for firing the charge, the water originally enclosed within the chamber 15″ has escaped through the unavoidable clearances between the pistons 16″ and 18″ and the chamber 15″ as well as through the calibrated escape orifice 33″. Upon rearming the apparatus later on, i.e. upon biasing the trigger 20 and piston 16″ into the rest and rearming position, precisely for compensating these water leaks, the escape orifice 33″ plays a filling and suction role through which, by means of displacement of piston 16″ under the biasing action of spring 17″, water is sucked in to complete the action of spring 17″ and begins to fill the chamber 15″ with water priro to the piston 16″ uncovering the intake orifices 23″. Clearances between pistons 16″ and 18″ and the wall of chamber 15″ as well as orifice 33″ make rearming of the apparatus easier.

In FIG. 6, the tumbler 18‴ is provided with a liquid passage duct 19‴ having a ball valve 30‴. Sealing between tumbler 18‴ and the wall of chamber 15‴ is provided by an O seal 34‴. The lower piston 16‴ is identical to that of FIG. 5. Spring 17‴ for returning the piston 16‴ here also bears on the two pistons 16‴, 18‴. The chamber includes several intake orifices 23‴. In the position shown in FIG. 6, chamber 15 is in the filling phase and the liquid pressure which reigns there is zero.

If the apparatus provided for the system including the percussion chamber of FIG. 6 is out of the water, when the trigger is operated, through its finger 19‴ the air is compressed and escapes partially through the clearances, and tumbler 18‴ does not move. If the apparatus is used immersed, the two pistons 16‴, 18‴ are interlocked in movement, the travel of piston 16‴ required for moving tumbler 18‴ and unlocking the bolt 11‴ being greater than that which it requires for counterbalancing leaks. Upon rearming the apparatus, and as before, water is sucked into the chamber 15‴, but through duct 29‴, ball 30‴being moved out of its seat.

In FIG. 7, which shows a particularly advantageous embodiment of the percussion chamber, the tumbler 18'ᵛ includes a liquid intake duct 29'ᵛ, opening into chamber 15'ᵛ and which may be closed by a flexible non return membrane 35'ᵛ carried by a plug 36'ᵛ engaged in a recess 37'ᵛ formed in the tumbler. During the filling phase membrane 35'ᵛ does not prevent the liquid from passing through duct 29'ᵛ, and, during the unlocking phase, it provides a sealing function against the wall of the chamber and closing of the intake duct 29'ᵛ the lower piston 16'ᵛ, in the form of a U rotated through 90°, contains the finger 19'ᵛ of the trigger, in the form of a ball joint. Sealing between piston 16'ᵛ and the wall of chamber 15'ᵛ is here provided by an O seal 38'ᵛ. The chamber in this case no longer has the liquid intake orifices of the other embodiments, duct 29'ᵛ playing that role. A calibrated discharge orifice 33'ᵛ has however been formed in the wall of the chamber so as to allow a small leak and thus make sure that the system cannot operate out of the water. This orifice 33'ᵛ is however not indispensable.

When the trigger comes back to the cocked position of the striker, piston 16'ᵛ is driven downwardly therewith, in FIG. 7, causing a pessure reduction in chamber 15'ᵛ, until it abuts against a piece, not shown.

Then, membrne 35'ᵛ is disengaged from tumbler 18'ᵛ so as to free duct 29'ᵛ, operating as a suction duct, and allow filling of the chamber.

With the apparatus shown in FIG. 7, the travel of piston 16'ᵛ, fast with finger 19'ᵛ of the trigger, avoiding thus the provision of a spring, may be greater than that of tumbler 18'ᵛ allowing unlocking of the striker 3'ᵛ, whereby an air leak through orifice 33'ᵛ may be more readily tolerated when the apparatus is out of the water, so as to make the apparatus unusable.

Figure 4:
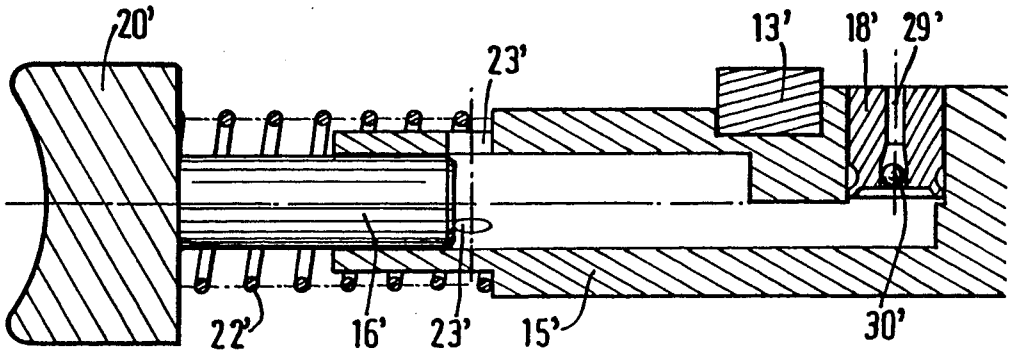
FIG. 4 is a partial view in axial section of the percussion chamber of the percussion system of a second embodiment of the apparatus of the invention, before firing.

The embodiment of the apparatus of the invention shown in FIG. 4, in the same position before firing as in FIG. 2, includes a different mechanism for actuating tumbler 18'. The same functional elements as in the preceding figures bear the same references but with a prime, such for example as the key 13'. Tumbler 18' is formed with a through duct 29' in which is disposed a ball 30' playing the role of valve. Trigger 20' is extended by a rod 16' mounted for sliding in chamber 15' against the action of its return spring 22'. Chamber 15, no longer substantially cylindrical but elbowed, is provided with water intake orifices 23'. Cocking of the striker is provided here under the action of the recoil of the barrel when applying the apparatus against the material receiving the fixing element. When an operator presses trigger 20', with the apparatus immersed, so as to drive it into chamber 15' against the action of its spring 22', rod 16' closes the intake orifices 23' and ball 30' closes duct 29'. Under the action of the trigger, the tumbler 18' is then moved as before for releasing the striker. When trigger 20' is released, the action of its spring 22', moves the rod 16', which causes a movement of liquid in chamber 15'. Then, ball 30' also moves in a limited way, opens duct 29', the liquid penetrates into chamber 15' through duct 29' and participates, with spring 22', in urging the trigger 20' to the rest position so as to thus to ensure that the intake orifices 23' are indeed finally uncovered. It will be noted that cocking of the striker could also be operated by means of a lever.

The embodiments of the percussion system of the apparatus of the invention as shown in FIGS. 1 to 7 include a percussion chamber with a percussion piston (18—18'ᵛ) which is in fact the tumbler for unlocking the striker.

In the embodiment of the percussion system of the apparatus of the invention, shown in FIGS. 8, 9 and which will now be described, the percussion piston is adapted so as to serve as stop for the striker in its percussion travel caused by actuation of a separate tumbler.

Advantage will be taken of this final description to discuss more explicitly the tubular charge holder element not described above.

Figure 8:
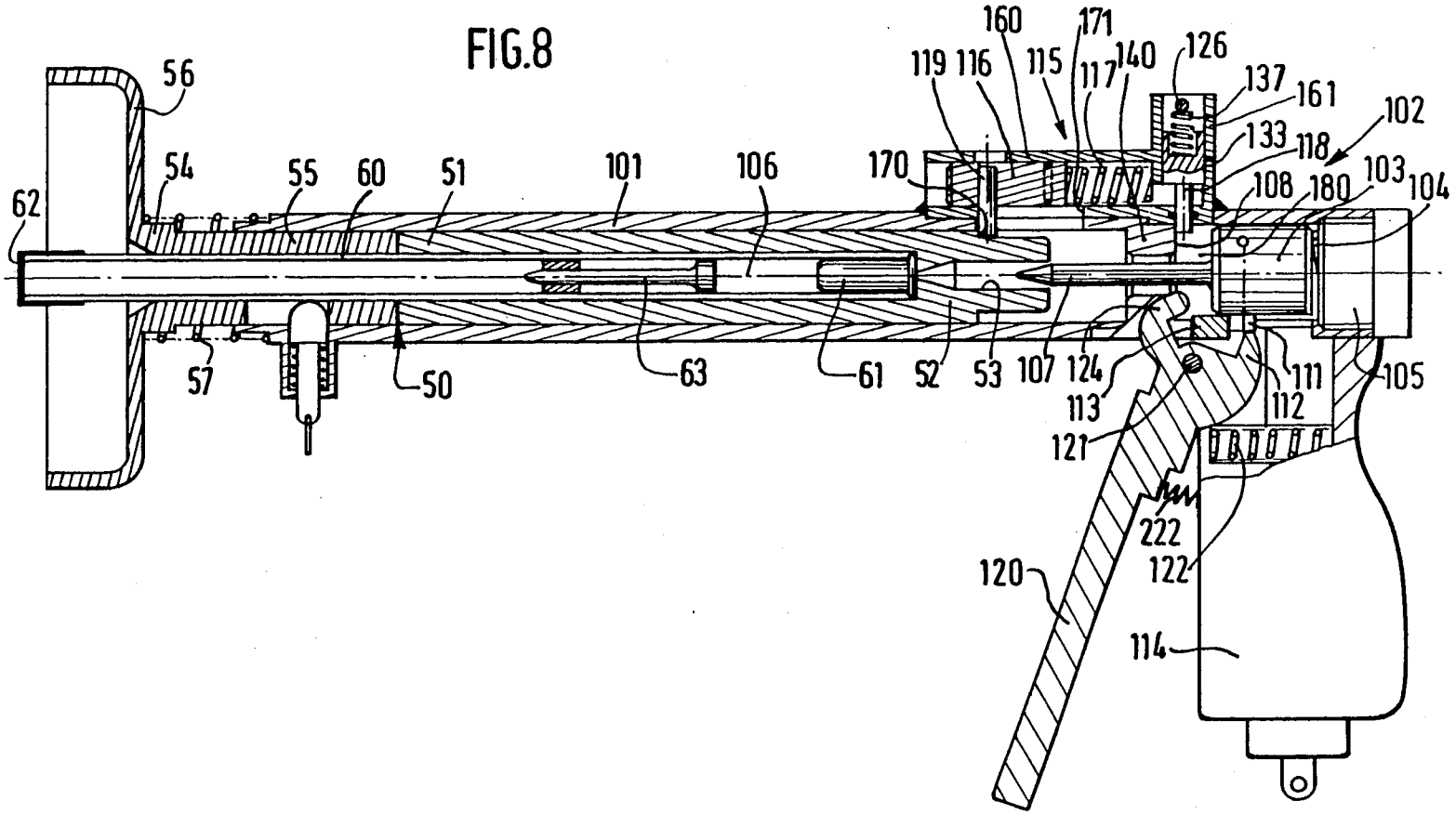
FIG. 8 is an axial sectional view of the apparatus of the invention with a fourth variant of construction of the percussion system, with the apparatus not immersed, before firing thereof and after cocking.
Figure 9:
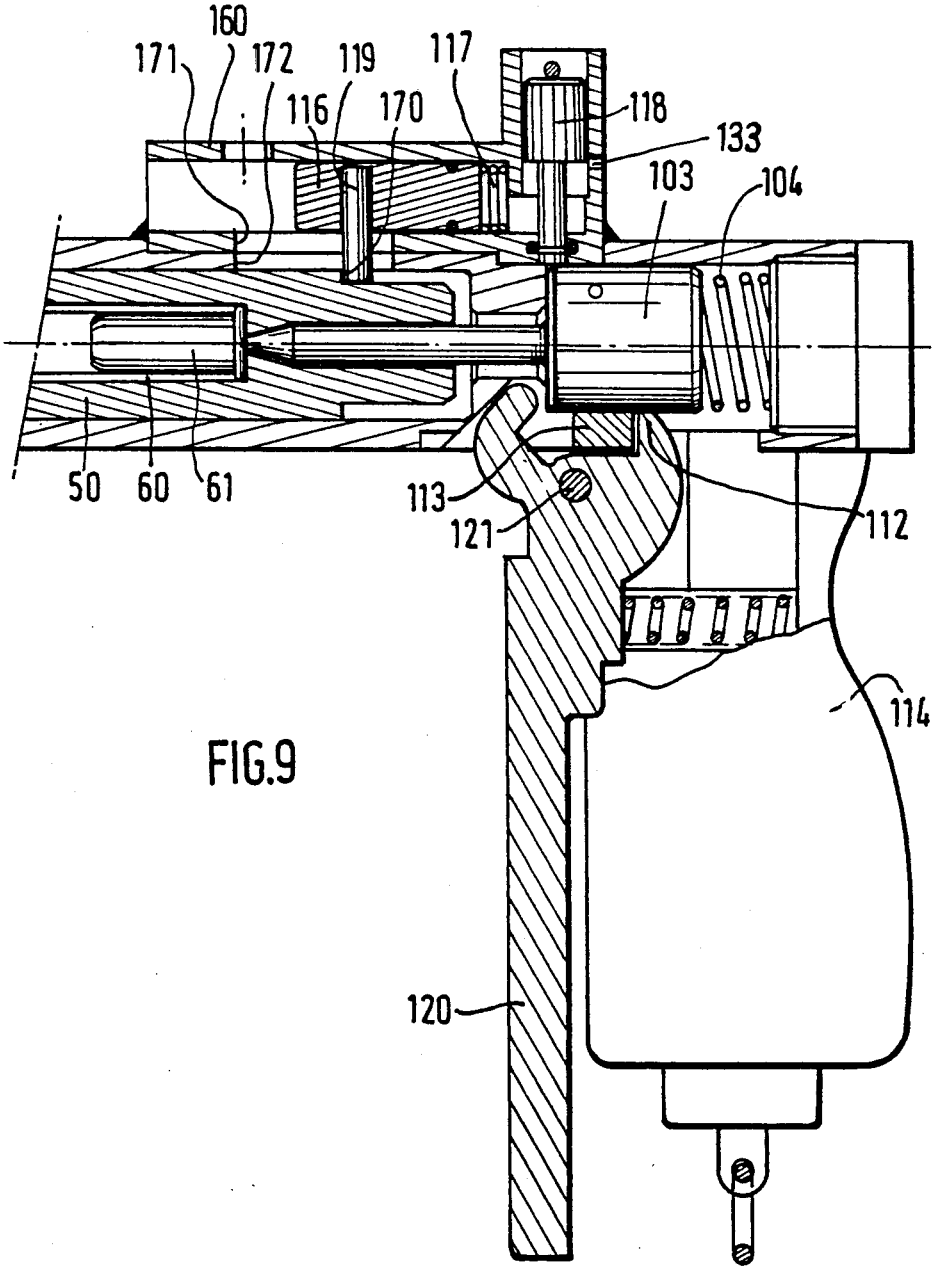
FIG. 9 is a view similar to that of FIG. 8, with the percussion system immersed and after firing.

With reference then to FIGS. 8 and 9, the apparatus includes a barrel holder 101 with axis 106, in which is mounted a barrel assembly 50, in which is mounted a tubular element 60. at the rear end of the tubular element 60 is crimped a propulsive powder charge 61, the other end of the tubular element being closed by a closure device 62 made from a material which may be perforated by the fixing rlement 63 disposed inside the tubular element which will serve as guide therefor after firing. In this respect, the tubular element 16 is the barrel properly speaking of the apparatus, assembly 50 playing then also a role as barrel holder for the guide element of the fixing element. Barrel 50 includes two independent parts, a first rear tubular part 51, at the bottom of the bore of which the rear end of the tubular element 60 is received, and the rear part 52 of which is formed with a bore 53 for receiving the front rod of the striker; a second front part 54 formed of a rear tubular portion 55, mounted in the barrel holder 101 and an application end piece 56 of an appreciably larger diameter. The intermediate barrel part 55 is mounted for sliding in the barrel holder under the action of a return spring 57.

At the rear of the barrel holder 101 is disposed a system 102 for firing the charge. This system includes a striker 103, with a front rod 107 urged forwardly by a percussion spring 104 engaged, as in the previously described embodiments, against the bottom of an axial recess of the striker and the bottom of a removable base 105, so as to come into abutment against an annular shoulder 108 of the rear part 140 of the barrel holder, forming a breech. Striker 103 comprises, mounted like that of the above described embodiments, a cocking bolt 111, movable transversely against the action of a return spring. In FIG. 8, with the apparatus shown after cocking and before immersion and application thereof, the cocking bolt 111 projects from its housing, urged by its spring and abuts against the fixed key 113.

Extending substantially between the transverse zone of key 113 and a front transverse zone in which charge 61 is located, with the apparatus applied (FIG. 9), a percussion chamber 115 is fixed on the barrel holder 101. Chamber 115, in the form of an upturned L, has a substantially tubular front portion 116 extending parallel to the axis 106 of the apparatus and a rear portion 161 also substantially tubular but extending transversally to the axis 106. Portion 160 of chamber 115 and the barrel holder 101 have respectively two windows 171, 172, through which extends trnsversally to axis 106 a percussion finger 119 driven into a piston 116 sliding in the chamber portion 160 against a spring 117 disposed between this piston 116 and a shoulder formed by the junction of the two chamber portions 160, 161.

The percussion bolt 118 is mounted in the rear chamber portion 161. It may slide against the action of a spring 137 applied against the bottom of a recess formed for this purpose in the piston and pin 126.

A trigger 120 is mounted for pivoting on the grip 114 about pin 121, against the actions of two springs 122 and 222. It has two fingers 112, 124. Finger 112 is disposed so as to serve as tumbler and drive the cocking bolt 111, and finger 124 is disposed for cooperating with the striker 103 and driving it rearwardly, against the action of its spring 104, in the cocked position.

The percussion finger 119, cooperates with a rearwardly turned annular shoulder 170 formed on the rear part 52 of barrel 50.

In the position shown in FIG. 8, trigger 120, under the action of the spring 122, is moved away from grip 114 but is urged slightly towrds it by spring 222 and, via its finger 124, it rocks the striker 103 whose cocking bolt 111 has been pushed back behind key 113. Spring 117 has pushed piston 116 towards the front of chamber 115 and the percussion finger 119, fast with piston 116, through the shoulder 170 has pushed back the rear barrel portion 51 and, with it, the tubular element 60, into the forward position. The rear portion 51 of the barrel and spring 57 have pushed the front portion 54 of the barrel forwardly. The free end of the percussion piston 118 is now projecting out of the chamber portion 161 beyond a seal, pushed by its spring 137 into the space 180 formed between the breech 140 and the striker 103 so as to insert therebetween and thus prevent percussion of the charge. Chamber 115 is filled with liquid which has penetrated through window 171, playing the role of intake orifice.

In the position shown in FIG. 9, after firing, and with the apparatus immersed, application of the apparatus had first of all pushed the tubular element 16 and barrel 50 rearwardly against the action of spring 57 as well as that of spring 117, movement of barrel 50, through shoulder 170 and finger 119, having caused piston 116 to recoil into the chamber portion 160. The recoil of piston 116 had closed the intake window 171, the volume of water enclosed in cjhamber 115 had been driven towards the percussion piston 118 which had then been urged upwardly, in FIG. 9, against the action of its spring 137, thus freeing the space 180 between the breech and the striker. Then, operation of trigger 120 causing it to pivot about pin 121 and bringing it closer to grip 114 against the action of spring 122 had, through its finger 112, pushed back the cocking bolt 111 against the action of its spring, until it is flush with the upper surface of key 113 so as tocause the striker 103, under the action of its spring 104, to be propelled forwardly, to follow its complete travel and to cause percussion of the charge 61.

It will be noted that, so as to provide correct operation of barrel 50 in the barrel holder 101, at the end of recoil, in the wall of the chamber portion 161 has been formed an orifice 133 for removing the excess liquid, this orifice also playing the role of intaking the liquid into chamber 115, for rearming the apparatus, like orifice 33 of the embodiments of FIGS. 5–7, upon return of the piston 116 into the rest position. This orifice 133 may moreover be of one of the types of the orifices 29 and 33 of FIGS. 5–7.

If the apparatus is out of the water, as in the embodiment shown in FIGS. 1 to 7, the air in chamber 115 is compressed, in any case not enough for pushing back sufficiently the percussion piston 118 which remains inserted between the breech and the striker preventing this latter from assuming its function after actuation of the tumbler.

When the worn tubular element 60 is removed, for replacing it by a new one, spring 117 through piston 116 and finger 119 pushes the rear barrel portion 51 forwards; the percussion piston 118, pushed out of chamber 161 by its spring 137, comes into abutment against striker 103, before being able to insert itself again between the breech and the striker after this latter has been recocked.

In the description of FIGS. 8, 9 it was a question more particularly of the percussion piston, of the percussion finger, and of the percussion role of the barrel. In actual fact, it would have been more appropriate to speak of safety or unlocking piston, of operating finger and of the lever roller of the barrel. However, since these different parts are functionally related closely to the so called percussion chamber, so as to emphasise the fact that they belong to this percussion enabling assembly, it was preferred to qualify them thus.

I claim:

1. Sealing apparatus including a barrel holder, a barrel for guiding a fixing element intended to be driven by the action of the combustion gases of a propulsive charge and a percussion system for setting off the charge including a striker mounted in a breech, a bolt for arming the striker, a tumbler for releasing the bolt and a trigger for actuating the tumbler characterized by the fact that the percussion system includes a chamber having at least one liquid intake orifice, a percussion piston movable in the chamber and operable means adapted when operated, for closing the intake orifice, pushing back the liquid and moving the percussion piston and thus allowing percussion of the charge, and a suction orifice for sucking liquid into the chamber upon biasing the operable means into rest and rearming position.

2. Apparatus according to claim 1, wherein the chamber is disposed so that the percussion piston may insert itself between the breech and the barrel and serve as stop therefor when said operable means are not operated.

3. Apparatus according to claim 1, in the barrel of which is mounted a tubular element at one end of which the propulsive charge is disposed, the other end of the tubular element being closed by a closure means perforable by the fixing element disposed inside the tubular element.

4. Apparatus according to claim 1, wherein the suction orifice is closable.

5. Apparatus according to claim 4, wherein the closable suction orifice is the intake orifice.

6. Apparatus according to claim 1, wherein the chamber is provided with an escape orifice.

7. Apparatus according to claim 6, wherein the escape orifice is the suction orifice.

8. Apparatus according to claim 1, wherein the percussion chamber is disposed so that the percussion piston may insert itself between the breech and the striker, and serve as stop therefor when said operable means are not operated.

9. Apparatus according to claim 8, wherein said operable means are adapted for cooperating with a percussion finger fast with another piston movable in the chamber against the action of a return spring.

10. Apparatus according to claim 8, wherein said operable means include the barrel.

11. Apparatus according to claim 8, wherein said operable means include the trigger.

12. Apparatus according to claim 8, wherein the tumbler is fast with the trigger.

13. Apparatus according to claim 8, wherein the trigger includes a finger for cocking the striker.

14. Apparatus according to claim 1, wherein it is the percussion piston which plays the role of tumbler and the trigger the role of said operable means.

15. Apparatus according to claim 14, wherein the striker is adapted so as to be placed in the cocked position under the action of the recoil of the barrel during application of the apparatus against a material receiving the fixing element.

16. Apparatus according to claim 15, wherein the trigger is mounted for sliding in the percussion chamber.

17. Apparatus according to claim 16, wherein the suction orifice is closable and it is formed in the percussion piston.

18. Apparatus according to claim 14, wherein the trigger includes a finger for cocking the striker.

19. Apparatus according to claim 18, wherein the trigger includes a percussion finger adapted for cooperating with another piston movable in the chamber.

20. Apparatus according to claim 19, wherein said other piston is fast with the percussion finger with respect to displacement and the suction orifice is in the intake orifice, it is closable and it is formed in the percussion piston.

21. Apparatus according to claim 19, wherein said other piston is subjected to the action of the return spring.

22. Apparatus according to claim 21, wherein the suction orifice is closable, and it is formed in the percussion piston.

* * * * *